United States Patent [19]

Szekeres

[11] 4,090,337

[45] May 23, 1978

[54] FLEXIBLE FORM FOR CEMENTITIOUS SLURRY

[75] Inventor: John M. Szekeres, Parma, Ohio

[73] Assignee: Medina Plastic Products, Inc., Medina, Ohio

[21] Appl. No.: 823,290

[22] Filed: Aug. 10, 1977

[51] Int. Cl.[2] ..... E02B 3/12; E04B 1/345

[52] U.S. Cl. ..... 52/309.1; 52/426; 52/650; 52/662; 61/38; 85/49; 428/100; 428/101

[58] Field of Search ..... 61/3, 37, 38; 85/49; 52/169.1, 426, 650, 662, 2, 309.1; 428/100, 101, 223

[56] References Cited

U.S. PATENT DOCUMENTS

| | | | |
|---|---|---|---|
| 3,425,227 | 2/1969 | Hillen | 61/38 |
| 3,468,088 | 9/1969 | Miller | 52/426 |
| 3,486,341 | 12/1969 | Huesker-Stieue et al. | 61/38 |
| 3,555,751 | 1/1971 | Thorgusen | 52/426 X |
| 3,570,254 | 3/1971 | Turzillo | 61/38 |
| 3,757,629 | 9/1973 | Schneider | 85/49 |

*Primary Examiner*—Alfred C. Perham
*Attorney, Agent, or Firm*—Hamilton, Renner & Kenner

[57] ABSTRACT

Overlying first and second sheets of flexible fabric may be employed to make a form for slabs of concrete, or the like, when the sheets are adequately connected at spaced intervals. A novel connector for such purpose is disclosed herein and comprises a unique, staple-like configuration by which to permit separation of the sheets to a substantial but limited extent. Each connector has at least one shaft with a crown at one end and a point at the other end. A barb is provided in proximity to the pointed end of the shaft and presents a reentrant tip spaced laterally of the shaft and disposed in a direction opposite the point on the shaft. A bridge spans between the barb and shaft. The point permits facile penetration of both sheets with the crown limiting the extent to which the shaft can penetrate the first sheet. The reentrant tip on the barb permits facile retropenetration of the second sheet, and the bridge engages a sufficient portion of the second sheet to preclude withdrawal.

7 Claims, 6 Drawing Figures

FLEXIBLE FORM FOR CEMENTITIOUS SLURRY

BACKGROUND OF THE INVENTION

This invention relates to the forming of concrete slabs in situ for protecting earthen, and particularly sloping earthen, surfaces against erosion by virtue of flexible fabric forms. A plurality of novel connectors are used in conjunction with overlying sheets of flexible fabric to provide a form which readily comports to the surface on which it rests and yet insures that when a cementitious slurry is introduced between the overlying sheets a resulting slab of substantially uniform thickness is produced.

In order to control erosion along earth embankments, hill slopes and shorelines, concrete slabs and structures are placed, or constructed, at such sites. Construction along a sloping, undulating terrain is made possible by the use of flexible fabric, or bag-like, forms which allow the structure to conform to the underlying surface contour of the earth, while preventing the cementitious slurry from slumping under the influence of gravity before hardening.

The fabric bags, or sheets, are placed on the site at the desired, permanent location for the finished structure. A cementitious slurry is pumped into the bag-like form where it hardens into the concrete structure. In order to prevent unregulated flowing and bulging of the slurry within the fabric sheets themselves, and to control the thickness of the concrete layer to be formed, it is necessary that means to fasten and means to space the upper and lower layers of fabric sheets be employed at regular intervals.

A variety of fastening and spacing means are known to the art, each having its own drawbacks. In one prior art embodiment the two layers of fabric are stitched, or sewn, together at regular intervals to reduce the excessive bulging of the flexible form at lower levels of the slope which results if the slurry is permitted to slump before hardening. But the thickness of the structure formed is not even substantially uniform — there is little or no concrete deposited in the area covered by, and immediately surrounding, the stitching. In addition, stitching or sewing at the construction site often is not feasible, so that the fabric must be sewn and prepared beforehand, without regard to the peculiarities of specific sites.

In another prior art embodiment, fastening is accomplished by pulling both overlying layers of fabric through a ring and preventing retraction by use of a pin, spike or other stop means. As with stitching, the structure formed lacks substantially uniform thickness — no concrete being present at the point of juncture. Although the fabric can now be prepared on site, the preparation involves the tedious, inefficient process of grabbing both layers of fabric, drawing them through the ring, and fastening them there.

In yet another prior art embodiment, a plurality of threaded rods are anchored in the ground, and one or more stop means are received on each rod to serve as the elements by which to control the extent to which the overlying sheets separate when slurry is introduced therebetween. With this arrangement it is generally necessary to prepare the fabric beforehand with holes for the rods, so that the fabric is not torn during installation. The expense of the rods and stop means is a factor that must be considered, as well as the tedious labor of fastening the stop means to the rod after insertion through the fabric at the construction site.

Another type of fastening means employed with flexible, overlying sheets comprises a network of thick cords, attached to one sheet of fabric by stitching or wire hooks, and either interwoven with corresponding cords from the other sheet of fabric, or clipped by a wire hook to such cords. Here, too, the fabric must be prepared before installation at the site, with the attendant expense of pre-preparation.

Wire hooks are sometimes sewn onto one layer of fabric before transporting to the construction site. The second layer is then hooked onto the wire on site. In addition to the expense of using multiple component fastening means — i.e., the wire hooks and the stitching — the drawbacks common to all methods which require preliminary preparation of the fabric also exist.

The optimal means for fastening and spacing the fabric in this art should be: inexpensive; capable of being installed quickly and easily on site; capable of imparting substantially uniform thickness to the structure when inserted at approximately 6 to 24 inch intervals; and, should be able to withstand on the order of an eighty pound tensile load, when so spaced, for every two-inch thickness of concrete desired.

SUMMARY OF THE INVENTION

It is therefore a primary object of the present invention to provide a new and novel means to fasten two overlying sheets of flexible fabric into a form for pouring a slab of concrete or the like.

It is another object of the present invention to provide an improved means by which to connect and space two overlying sheets of flexible fabric into a form, as above.

It is a further object of the present invention to provide a connector means, as above, which can be inexpensively fabricated out of a plastic material and yet afford sufficient strength to withstand the stress imposed by the tendency of the cementitious slurry to slump without degrading the flexible sheet material.

It is an even further object of the present invention to provide a connector, as above, which alleviates the need for preliminary treatment of the fabric — such as sewing, stitching, or attaching hooks, cords, or other fastening means thereto — prior to positioning of the fabric on the situs where it is to be used.

These and other objects of the present invention, together with the advantages thereof over existing and prior art forms, which shall become apparent from the specification which follows, are accomplished by means hereinafter described and claimed.

In general, a form for shaping slabs of concrete, or the like, according to the concept of the present invention, comprises overlying first and second sheets of flexible fabric material loosely woven of cord-like filaments. A plurality of novel, individual connectors cooperatively interengage the overlying first and second sheets to permit separation thereof to a substantial, but limited, extent.

Such connectors have at least one shaft with opposite ends — one end being provided with a point to pierce the two overlying sheets and the opposite end being provided with a crown to engage the first sheet and thereby limit the extent to which the shaft can penetrate the first sheet.

A barb is provided on the shaft in proximity to that end of the shaft which terminates in a point. The barb presents a re-entrant tip that is spaced laterally of the shaft and disposed in a direction opposite the point on the shaft. A bridge spans between the shaft and the re-entrant tip to engage a sufficient extent of the second sheet to preclude withdrawal of the shaft without degradation thereof within the design parameters of the connector.

One preferred embodiment of the present invention is shown by way of example in the accompanying drawings and is described in detail without attempting to show all of the various forms and modifications in which the invention might be embodied; the invention being measured by the appended claims and not by the details of the specification.

DESCRIPTION OF THE PREFERRED EMBODIMENT

Figure 1:
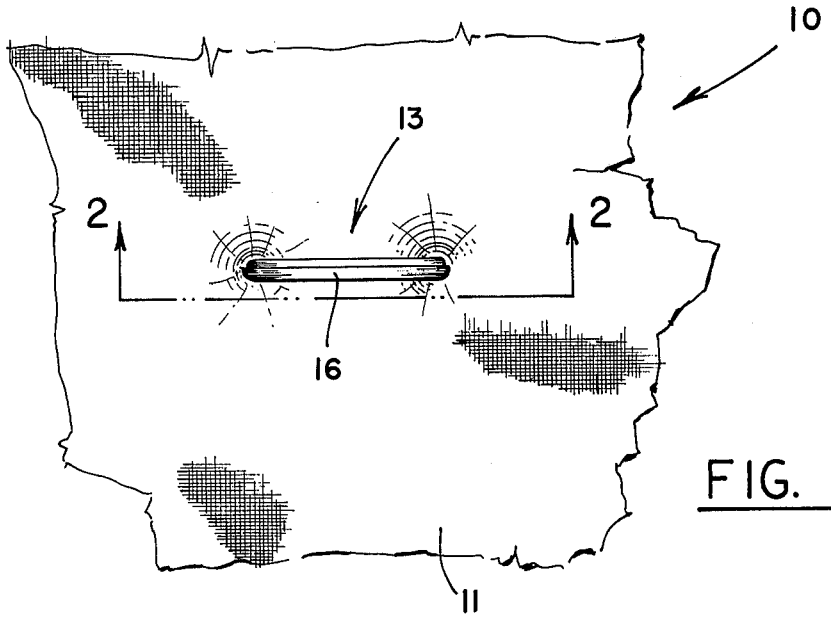
FIG. 1 is a top plan view of a portion of a flexible form for shaping slabs of concrete, or the like — the form comprising overlying first and second sheets of fabric material functionally joined by a novel connector to receive and retain cementitious slurry which becomes the concrete.
Figure 2:
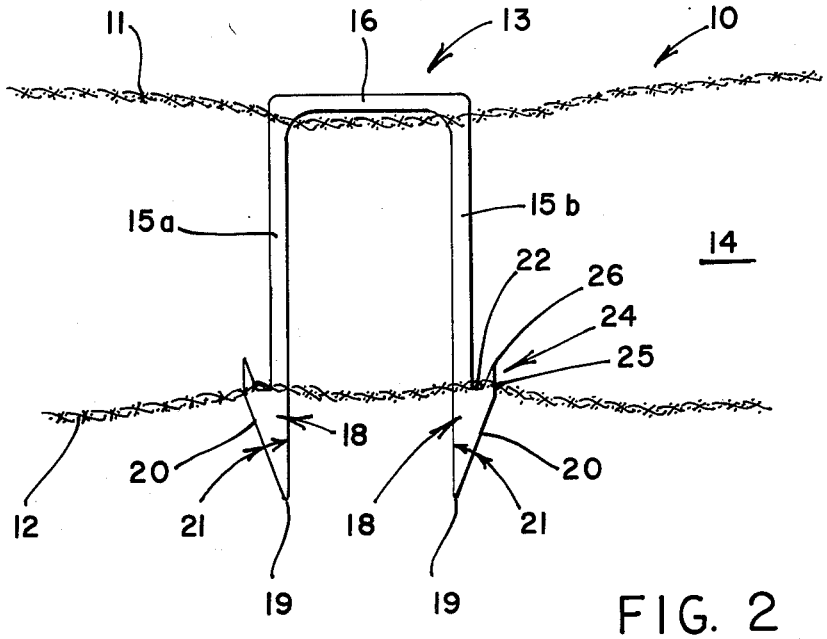
FIG. 2 is a vertical section through the form depicted in FIG. 1 and taken substantially along line 2—2 of FIG. 1 and depicting, in frontal elevation, a preferred form of the novel connector embodying the concept of the present invention and, in section, the overlying first and second flexible sheets of fabric between which cementitious slurry has been introduced.

A form for shaping concrete slabs and which incorporates the concepts of the present invention is designated generally by the numeral 10 in the attached drawings. The upper and lower walls of the form 10 are defined by overlying first and second sheets 11 and 12 of burlap-like fabric loosely woven from strands of nylon or comparable material. A plurality of novel connectors 13 interengage the first and second sheets 11 and 12 to permit a predetermined separation thereof when a cementitious slurry 14 is introduced therebetween.

In the preferred embodiment depicted in the drawings the novel connector 13 has a pair of substantially parallel, laterally spaced shafts 15*a* and 15*b* which extend outwardly from a common crown 16. Because the shafts 15*a* and 15*b* may be identical, only one will be described in detail. That end of the shaft 15 which is distal with respect to the crown 16 presents a triangular head 18 the apex of which terminates in a point 19 to facilitate piercing the overlying sheets 11 and 12.

The shaft 15 delineates one side of the head 18, and a wedging surface 20 — which intersects the shaft 15 at the point 19 to define an acute included angle 21 — defines the converging side of the head 18. A bridge 22 spans between the shaft 15 and a barb 24 at the outermost extent of the wedging surface 20 to define the third side, or base, of the triangular head 18. The bridge 22 is preferably disposed perpendicularly with respect to the shaft 15. The barb 24 comprises a pedestal 25 that extends outwardly from the juncture of the bridge 22 and the wedging surface 20 in parallel, laterally spaced relation with respect to the shaft 15 and itself terminates in a reentrant tip 26 oriented in a direction opposite to the direction of the point 19.

Each shaft 15 is preferably identical, and when parallel shafts extend outwardly from a common crown 16, as depicted in the preferred embodiment, the heads 18 and barbs 24 perferably lie in a common plane and, in relation to the other shaft, on the opposite side of the shaft to which they are conjoined for a purpose hereinafter more fully described.

In its preferred embodiment the connector 13 may be made of relatively inexpensive injection molded polypropylene, but any suitable rigid, or semi-rigid, plastic with elastic memory may be employed without departing from the scope of the present invention.

Figure 5:
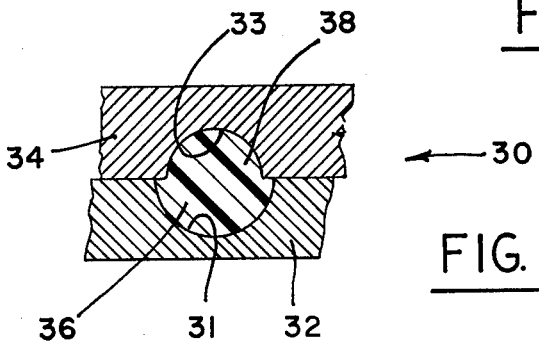
FIG. 5 is an enlarged, transverse section taken substantially along line 5—5 of FIG. 3, said section being depicted in conjunction with a mold in which the connector may be made; and, FIG. 6 is an enlarged, transverse section taken substantially on line 6—6 of FIG. 3.

The cost of using connectors 13 may be even further reduced without compromising the integrity of the connectors by molding the connectors in an opposed cavity mold 30 wherein the opposed cavities need not precisely register. As shown in FIG. 5, the cross section of the cavity 31 in mold section 32 may be of a given radius, and the cross section of cavity 33 in mold section 34 may be of a lesser radius. By making the opposed cavities 31 and 33 of different radii the precision required fully to register the opposed cavities is obviated, and yet the overall cross section of the resulting connector can be of the exact area required to impart the necessary strength.

Thus, as shown in FIG. 5 the cross sectional configuration of the shafts 15*a* and 15*b* and crown 16 in the connector 13 generally comprises a semi-cylinder 36 of one radius in opposed juxtaposition with a semi-cylinder 38 of letter radius.

Figure 3:
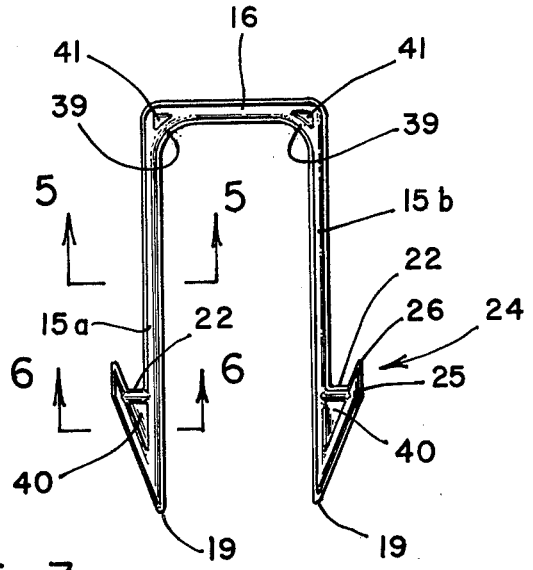
FIG. 3 is a frontal elevation of the connector per se depicted in FIG. 2.
Figure 4:
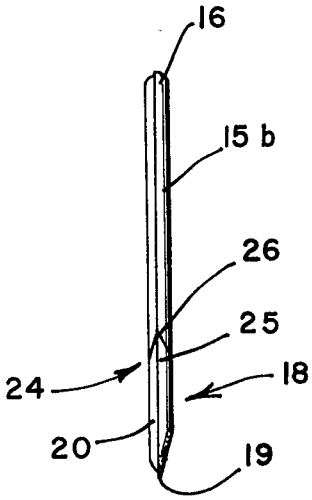
FIG. 4 is an end elevation of the connector depicted in FIG. 3.
Figure 6:
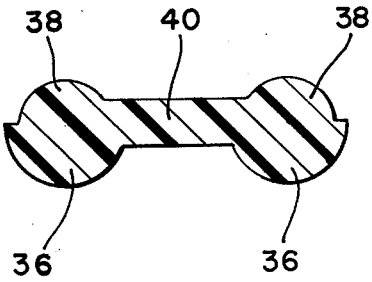

Experience has shown that the juncture of the shaft 15 to the crown 16 must be haunched to preclude failure. The necessary haunching can be achieved by use of a radial fillet 39 at that location. And, as depicted in FIG. 6 when the lateral surfaces of a section in said connector exceed the combined radii of said semi-cylinders 36 and 38 the interim portion may take the form of a web having a thickness less than the combined radii of said semi-cylindrical sections. Thus, as can be deduced from FIG. 3, the bridge 22 is formed of semi-cylindrical sections, as is the fillet 39. Accordingly, a triangular web 40 appears in the central portion of each head 18, and a generally triangular web 41 also appears between each fillet 39 and the adjacent portions of the shafts 15 and crown 16.

In order to impart a complete understanding of the present invention let it be assumed that one desires to protect a sloping, earthen back against erosion, and that a two-inch slab of concrete will accomplish the desired objective. In those situations where the environment of the bank makes it undesirable either to pour the slab in situ (e.g., the bank may be too steep to retain the slurry before it hardens or the presence of wave action would wash the slurry away before it hardens) or to position previously cast slabs (e.g., the contour of the bank makes installation of individual, precast slabs too onerous or the location of the bank is such as to compound the expense of transporting and positioning the precast slabs), the use of a form embodying the concept of the present invention to pour the slab in situ affords a most satisfactory solution.

To assemble the form, the overlying first and second sheets 11 and 12 of fabric are positioned upon the situs to be protected, and a plurality of connectors 13 are applied on location to interengage the overlying sheets. For example, the connectors 13 may be applied to the sheets so that the point 19 on each shaft 15 pierces both sheets 11 and 12. The wedging surface 20 serves to separate the strands of fabric and permit passage of the head 18 through the fabric by temporarily separating rather than severing or tearing the strands from which the fabric is woven. Once the head 18 has penetrated both sheets of fabric the barb 24 prevents withdrawal. When cementitious slurry is introduced between the overlying sheets of fabric 11 and 12 joined by the connectors 13, engagement of the crown 16 with the first sheet 11 limits the extent to which the shaft 15 can penetrate that sheet. Similarly, after the reentrant tip 26 pierces the second sheet 12 the bridge 22 limits the extent to which the barb 24 can retropenetrate the second sheet 12. The connectors 13 thereby permit separation of the overlying sheets to a substantial but limited amount.

Continuing with the example of a 2-inch slab, the connectors 13 are employed along transverse coordinates at intervals of 6 to 24 inches. There will be some pillowing of the flexible fabric between the connectors so that in order to provide a mean two-inch thickness the dimension of the shafts 15 from the crown 16 to the bridge 22 need only be approximately one and three-quarter inches.

The bridge 22 must have a span of sufficient dimension to engage an adequate number of fabric strands upon reentrant penetration of the barb 24 to withstand the load imparted by the introduction of the slurry between the overlying sheets 11 and 12.

When pouring a two-inch slab at the spacing suggested above each connector 13 must resist approximately an eighty pound load, and with a fabric woven as loosely as burlap a bridge span of approximately three thirty-seconds of an inch has been found to engage enough of the nylon strands to transfer such a load between the second sheet 12 and the shaft 15 with which that bridge 22 is associated without degrading the fabric. And, when a pair of shafts **15*a* and 15*b* depend from a common crown 16 in the example under consideration, a lateral spacing of approximately one inch between the shafts 15*a* and 15*b* serves to separate the high stress points in the fabric where the load transfer between the fabric and the bridge is effected, as is even further emphasized by having the bridges 22 on each connector 13** lie in a common plane and, in relation to the other shaft, on the opposite side of the shaft from which it is presented.

In view of the foregoing detailed description it should be apparent that a flexible form embodying the concept of the present invention accomplishes the objects thereof.

What is claimed is:

1. A form for shaping concrete slabs comprising: first and second sheets of fabric material loosely woven from cord-like filaments; a plurality of individual connectors cooperatively interengaging said first and second sheets to permit separation of said sheets a substantial but limited amount; each said connector having at least one shaft with opposite first and second ends; a point at said first end of said shaft to pierce said first and second sheets; a crown at said second end of said shaft to engage said first sheet and limit the extent to which said shaft can penetrate said first sheet; a barb in proximity to said first end of said shaft, said barb presenting a re-entrant tip spaced laterally of said shaft and disposed in a direction opposite the point on said shaft to pierce said second sheet; and a bridge spanning between said shaft and said barb to engage said second sheet and limit the extent to which said barb can retropenetrate said second sheet.

2. A form, as set forth in claim 1, in which a head is presented at said first end of said shaft, said shaft delineating one edge of said head; a wedging surface intersecting said shaft at an acute angle; said point presented at the intersection of said wedging surface and said shaft; said bridge spanning between said shaft and the outermost extent of said wedging surface; a pedestal extending outwardly from the juncture of said wedging surface and said bridge in parallel, spaced relation with respect to said shaft and itself terminating in said re-entrant tip.

3. A form, as set forth in claim 2, in which each said connector employs a pair of substantially parallel shafts extending from a common crown.

4. A form, as set forth in claim 3, in which said bridges and pedestals associated with each said parallel shaft lie in a common plane and, in relation to the other shaft, on the opposite side of the shaft with which they are conjoined.

5. A form, as set forth in claim 4, in which a radial fillet is provided on the interior angle formed by the intersection of each shaft with said crown.

6. A form, as set forth in claim 5, in which one side of said shaft and crown have a semi-cylindrical cross section of one radius and the other side has a semi-cylindrical cross section of lesser radius.

7. A form, as set forth in claim 6, in which said connector is polypropylene.

* * * * *